United States Patent [19]

Randles

[11] 4,285,680

[45] Aug. 25, 1981

[54] CARTON BLANK FEEDING AND GLUE APPLYING APPARATUS

[76] Inventor: Arthur E. Randles, 4617 S. 3rd Ave., Tucson, Ariz. 85714

[21] Appl. No.: 96,621

[22] Filed: Nov. 23, 1979

[51] Int. Cl.[3] ..... B31B 3/02; B31B 3/60

[52] U.S. Cl. ..... 493/132; 493/337

[58] Field of Search ..... 93/36 MM, 51 R, 51 M, 93/47, 36 R; 53/383; 493/337, 336, 333, 331, 150, 151, 130–132

[56] References Cited

U.S. PATENT DOCUMENTS

| | | | |
|---|---|---|---|
| 544,197 | 8/1895 | Staples | 93/51 R X |
| 2,794,373 | 6/1957 | Lindsay et al. | 93/51 R |
| 2,909,105 | 10/1959 | Lawrence | 93/51 R |
| 3,747,480 | 7/1973 | Kalikow | 93/51 R |

*Primary Examiner*—James F. Coan

*Attorney, Agent, or Firm*—Melvin R. Stidham

[57] ABSTRACT

A box forming machine wherein box blanks move along a slideway while glue wheels rotating below the slideway apply spots of glue to each carton blank before it reaches the folding station. A carriage, which is slidable over the slideway, has pusher fingers to push the blank and also carries a rack which engages a gear on the glue wheel shaft. The pitch diameter of the gear is equal to the outer diameter of the glue wheel so that the box blank, and the glue applying surfaces of the glue wheels move at precisely the same speeds at any given instant whereby the glue is applied in precise areas determined by the shape of the glue applying surfaces.

1 Claim, 4 Drawing Figures

CARTON BLANK FEEDING AND GLUE APPLYING APPARATUS

BACKGROUND OF THE INVENTION

In plunger-type folding machines carton blanks are moved along a slideway to be engaged by glue wheels which apply glue to selected flaps of the carton prior to folding. There are circumstances however, when it is desired to have the glue placed in spots of predetermined size and location in order to minimize glue consumption and to avoid the risk of having excessive glue squeezed out from between panels of folded cartons. In some machines this has been accomplished, to some extent by interrupting the peripheral surface of the glue wheels so that they do not apply a continuous strip. However, there still occurs some relative sliding as the carton accelerates and then decelerates over the slideway. Hence, precise glue application is not readily achieved.

OBJECTS OF THE INVENTION

It is an object of this invention to provide means for applying glue to a carton blank in precise areas and locations as it moves along a slideway.

It is a further object to provide a glue wheel for applying spots of glue to a carton blank wherein there is no relative sliding between carton blank and the glue wheel.

Other objects and advantages of this invention will become apparent from the description to follow, particularly when read in conjunction with the accompanying drawing.

SUMMARY OF THE INVENTION

In carrying out this invention, I provide glue wheels, which are mounted on a shaft carrying a gear. The gear is driven by engagement with a rack mounted on the same carriage that pushes the carton blanks across the slideway to the folding station. The pitch diameter of the gear is precisely equal to the diameter of the glue applying surfaces on the glue wheel so that such surfaces will move at precisely the same speed as the gear and, since the gear is driven by a rack on the carriage, at the same speed as the carton blanks moving across the slideway. Hence, the glue wheels can be adjusted to apply spots precisely where desired and, with no relative movement between carton blank and glue applying surface, the area and location of the glue spots can be precisely controlled.

DESCRIPTION OF A PREFERRED EMBODIMENT

Figure 1:
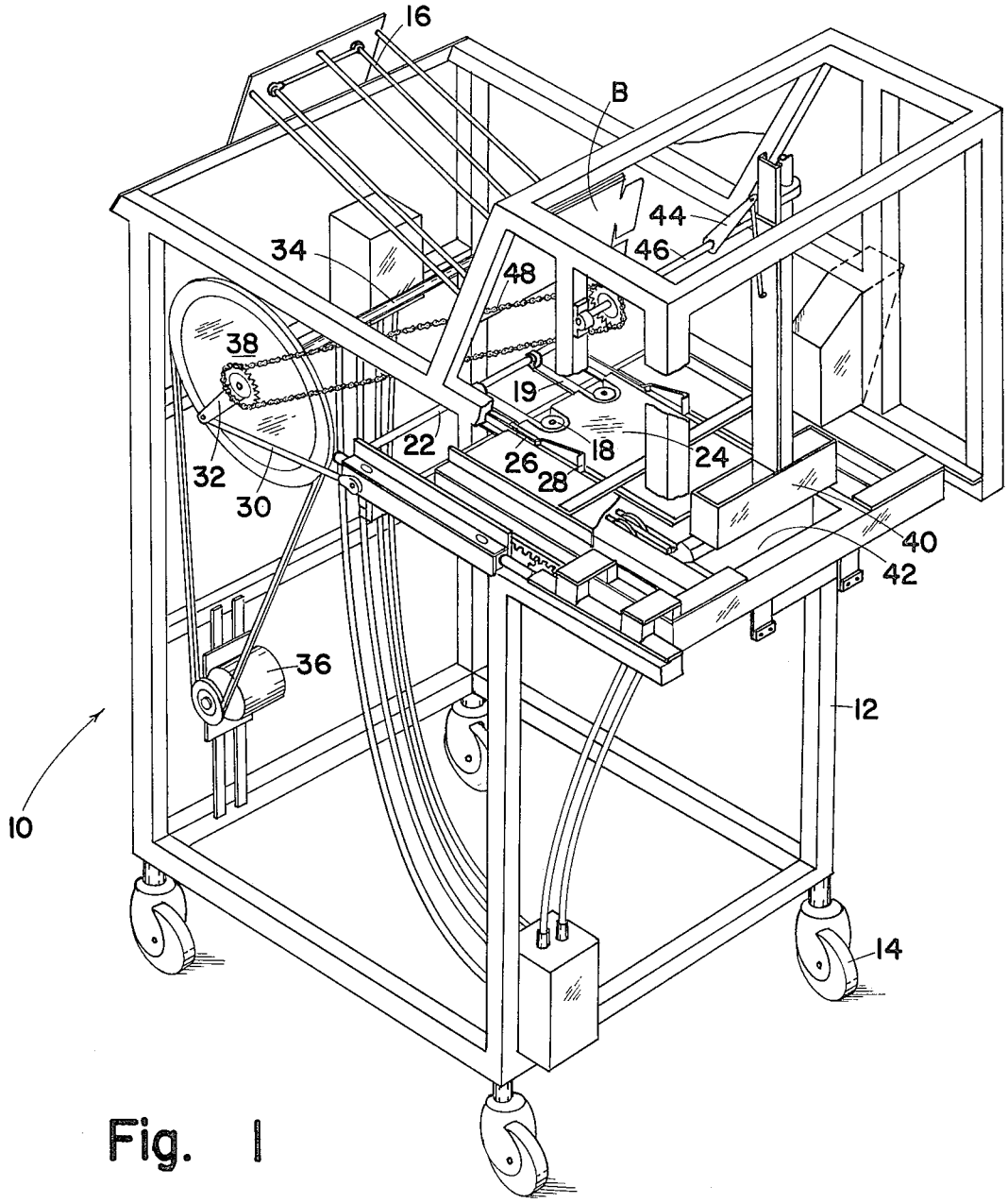
FIG. 1 is a view in perspective of a carton folding machine embodying features of this invention.

Referring now more particularly to FIG. 1, the box folding machine 10 of this invention is mounted on a frame 12 which, as shown, may be supported on wheels 14. The machine includes a magazine 16 for box blanks which are picked off one at a time by suction cups 18 carried on arms 19 secured to a rocker shaft 22. In operation, the suction cups 18 swing up from the position shown to engage a box blank B in the magazine 16, then return to release the blank on a slideway 24 by interruption of the vacuum through operation of conventional means.

A carriage 26 carrying push fingers 28 is reciprocated along the slideway 24 by means of a connecting rod 30 driven by a crank 32 on the main drive shaft 34, which in turn, is driven by suitably means such as an electric motor 36 through a pulley 38.

A plunger-type carton forming mechanism 40 is reciprocated vertically to fold carton blanks into a complementary well 42 by means of a crank 44 on shaft 46 which is driven from, and in tuned relation with, the drive shaft 34, as by means of a chain 48.

Figure 2:
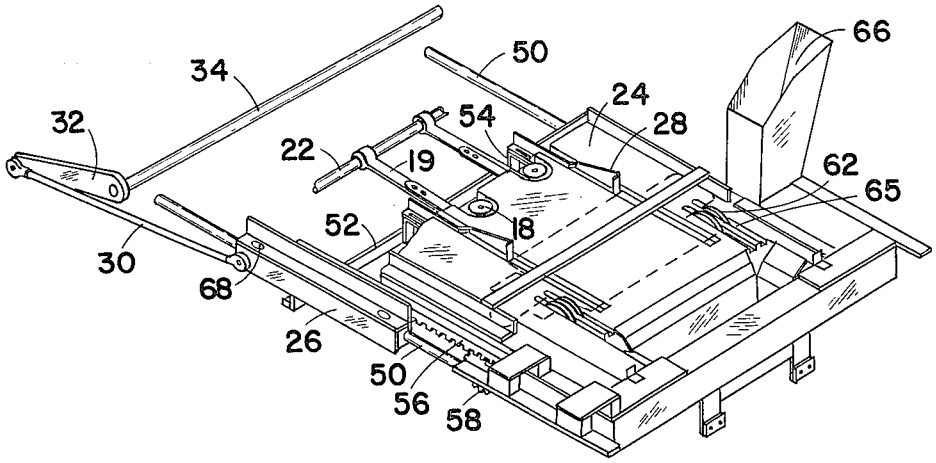
FIG. 2 is a view in perspective of the slide and folding table slideway of the machine.

Referring more particularly to FIG. 2, the carriage 26 is mounted for reciprocation on slide rods 50 on opposite sides of the slideway 24. The carriage 26 includes a cross bar 52 on which are mounted brackets 54 carrying the push fingers 28. Also supported on the carriage 26 is a rack 56 that meshes with a gear 58 carried on the glue wheel shaft 60.

Secured on a shaft 60 to rotate therewith are glue wheels 62 having projections 64 which engage the underside of the box blanks B as they pass over and apply spots of glue G in accordance with the spacing of the projections 64. The glue wheels 62 rotate in a glue tray 65 which may be filled through a funnel 66, to apply glue to the projections 64.

Figure 4:
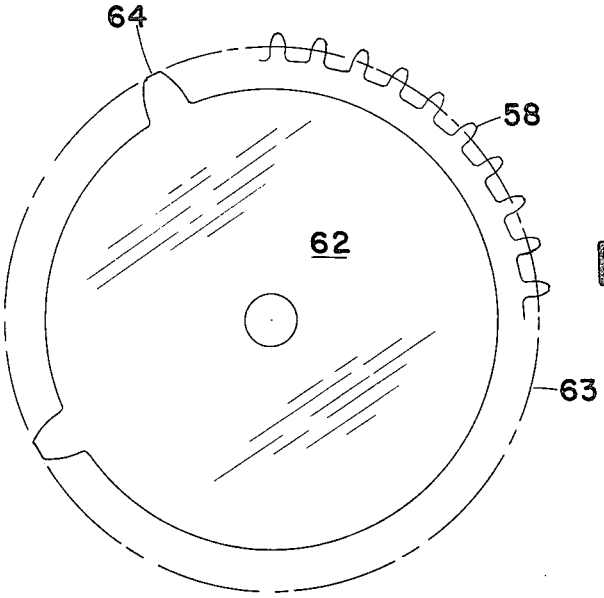
FIG. 4 illustrates the relationship between glue wheel diameter and pitch diameter of the driving gear.
Figure 3:
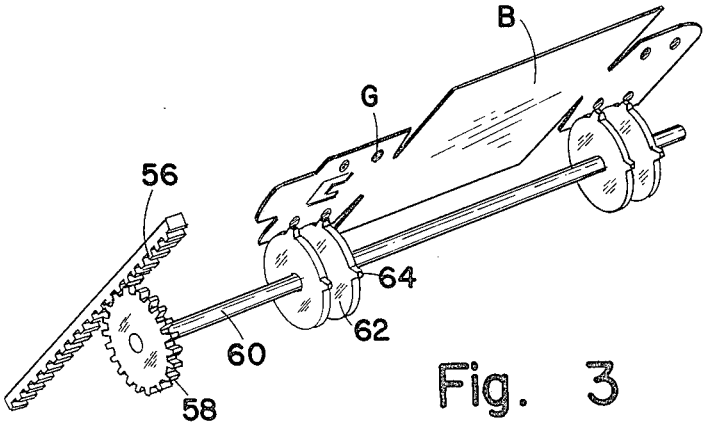
FIG. 3 is a partial view in perspective of the glue wheels.

As illustrated in FIG. 4, the projections 64 on the glue wheels 62 are of a diameter 66 which is precisely the same as the pitch diameter of the gear 58. Hence, outer glue applying surfaces of the projections 64 and the pitch diameter 66 will travel at precisely the same speed and, since the gear 58 is driven by the rack 56 on the carriage 26 the projections 64 will travel at precisely the speed of the carriage 26 at any given instant through acceleration and deceleration. Hence, the glue applying nodes 64 will travel at precisely the linear speed of the box blanks B as they pass over the slideway 24 so that each application of glue G will be by surface contact with no relative sliding between the nodes 64 and the carton blanks B. Slots 68 enable adjustment of the glue pattern.

In operation, the rack 56 is driven by the connecting rod 30 at the same speed as the carton blanks B from stationary at each extremities of the stroke through maximum velocity intermediate the ends, and the projections 64 on the glue wheels 62 will, likewise, rotate precisely at the same speed at each given instant. This provides greater control over glue application and the glue spots G can be applied precisely where desired and over areas determined by the peripheral areas of the projections 64.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention:

1. In a box forming machine including a generally horizontal slideway with a folding station at the downstream end thereof and glue wheels on a glue wheel shaft rotatable below said slideway in a glue container and having arcuately spaced radial projections thereon having outer surfaces of a common radius whereby they engage box blanks moving over said slideway to apply thereto spaced patches of glue;

the improvement comprising:

a carriage reciprocable along said slideway;

drive means connected to said carriage for reciprocating same;

pusher fingers on said carriage to engage and push a box blank on said slideway to said folding station as said carriage is extended from a retracted position;

a rack on said carriage to reciprocate therewith; and a gear on said glue wheel shaft having a pitch radius equal to the radius of said radial projections;

said rack meshing with said gear to rotate said glue wheels so that said outer surfaces move at the surface speed of said reciprocating carriage at any given instant.

* * * * *